US005838103A

United States Patent [19]

Park

[11] Patent Number: 5,838,103

[45] Date of Patent: Nov. 17, 1998

[54] FIELD EMISSION DISPLAY WITH INCREASED EMISSION EFFICIENCY AND TIP-ADHESION

[75] Inventor: Nam-sin Park, Suwon, Rep. of Korea

[73] Assignee: Samsung Display Devices Co., Ltd., Suwon, Rep. of Korea

[21] Appl. No.: 865,179

[22] Filed: May 29, 1997

Related U.S. Application Data

[63] Continuation of Ser. No. 487,446, Jun. 7, 1995.

[30] Foreign Application Priority Data

Jan. 27, 1995 [KR] Rep. of Korea ..... 95-1583

[51] Int. Cl.[6] ..... H01J 1/62; H01J 63/04; H01J 1/02; H01J 1/16

[52] U.S. Cl. ..... 313/495; 313/309; 313/336; 313/351

[58] Field of Search ..... 313/306, 307, 313/308, 309, 310, 336, 346 R, 351, 495; 315/169.3

[56] References Cited

U.S. PATENT DOCUMENTS

| | | | |
|---|---|---|---|
| 4,506,193 | 3/1985 | Hope et al. | 315/169.3 |
| 5,396,150 | 3/1995 | Wu et al. | 313/495 |
| 5,521,461 | 5/1996 | Garcia | 313/336 |
| 5,525,857 | 6/1996 | Gnade et al. | 313/336 X |
| 5,536,993 | 7/1996 | Taylor et al. | 313/309 X |
| 5,541,466 | 7/1996 | Taylor et al. | 313/309 X |
| 5,594,298 | 1/1997 | Itoh et al. | 313/336 |

*Primary Examiner*—Sandra L. O'Shea
*Assistant Examiner*—Mack Haynes
*Attorney, Agent, or Firm*—Foley & Lardner

[57] ABSTRACT

A field emission display and a method therefor, which can substantially improve uniformity of electrons emitted from numerous micro-tips formed to be applied to a flat panel display, by etching the edges of cathodes which are shaped into stripes and forming resistance portions in the etched areas, thereby improving an excessive etching and roughness made in etching a hole in an area for forming a micro-tip. Thus, the display is free of the decrease in tip-adhesion, so that the process efficiency can be increased up to 90% and the uniformity difference between the electrons emitted from a plurality of micro-tips can be maintained at ±5% in the edge and center of the cathode.

16 Claims, 2 Drawing Sheets

FIELD EMISSION DISPLAY WITH INCREASED EMISSION EFFICIENCY AND TIP-ADHESION

This application is a continuation of application Ser. No. 08/487,446, filed Jun. 7, 1995.

BACKGROUND OF THE INVENTION

The present invention relates to a field emission display and a method therefor, which can largely improve the uniformity of the current emitted from numerous micro tips provided in a flat panel display.

At present, plane-type image display devices, as a substitute for the cathode ray tubes of conventional television sets, are being developed and are under development for applications for image displays for a future wall television and a high definition television (HDTV) undergoing developmental work. Such plane-type image display devices include a liquid crystal device (LCD), a plasma display panel (PDP), a field emission device (FED), etc. Among them, the field emission device attracts attention in terms of display brightness and the economy of power consumption.

The field emission device can integrate, on a large scale, cathode tips as electron-emitting sources, at about $10^4$–$10^5$ tips/mm$^2$ per pixel, that is, per a unit pixel necessary for image display, thereby obtaining considerably high luminous efficiency and luminance. Moreover, since the field emission device has low power consumption, it is considered as a plane-type image display device appropriate for applications in the future wall television and HDTV.

FIG. 1 is a vertical cross-sectional view of a conventional field emission display.

The conventional field emission display includes a front glass substrate 8 and a rear glass substrate 1, which are placed opposite to each other at a regular interval. An anode 7 and a cathode 2 are formed into stripes, the stripes of the anode being in a crosswise direction to the stripes of the cathode, respectively on the inner surfaces of front glass substrate 8 and rear glass substrate 1. A resistance layer 3 is formed on rear glass substrate 1 on which cathode 2 is formed. A micro-tip 10 is formed in an array on resistance layer 3, for field emission. An insulator layer 4 is formed for surrounding micro-tip 10. A gate 5 is formed on insulator layer 4 to have an aperture 12 for permitting field emission above micro-tip 10. A florescent material layer 6 is formed for image display on front glass substrate 8 on which anode 7 is formed. A spacer 9 is provided to maintain a vacuum space 11 between fluorescent material layer 6 and insulator layer 4.

For manufacturing a field emission display having the above-described structure, the technology of forming an array of micro-tips having a radius of tens of nanometers (nm) and the technology of etching gate aperture 12 formed on gate 5 are predominantly essential. Lately, a strong electric field above the peak of the micro-tip is required to be about $5\times10^7$V/cm so that field emission is induced from numerous micro-tips. To create the strong electric field, the radius of the peak of the micro-tip required is about 50 nm and the distance between the peak of the micro-tip and a gate electrode, that is, the radius of a micro gate-hole should be below 1 $\mu$m. However, in a practical process, it is likely that errors are made in the radii of the peaks of the numerous micro-tips and the peak of the micro-tip is not apart from the gate electrode at a regular interval, thereby causing non-uniformity in the electrons emitted from each tip. The non-uniformity of the emitted electrons leads to the non-uniformity of the luminance of a fluorescent material layer formed on an anode.

To solve the above problems, the conventional field emission display having the structure illustrated in FIG. 1 is provided with resistance layer 3 which is shaped as a sheet between micro-tip 10 and cathode 2. However, there exist difficulties in obtaining uniformity in resistance layer 3 itself and in controlling the resistance value. Also, the adhesion of micro-tip 10 reduces according to the surface condition of resistance layer 3 and the geometrical structure of micro-tip 10 is distorted.

SUMMARY OF THE INVENTION

In order to solve the above problems, it is an object of the present invention to provide a field emission display and a method therefor, which can improve the uniformity of a resistance layer, greatly facilitate the control of resistance value, and prevent the reduction in the adhesion of a micro-tip and the distortion of the geometrical structure of the micro-tip.

To achieve the above object, according to the present invention, there is provided a field emission display including, a front substrate and a rear substrate placed opposite to each other at a predetermined distance, anodes and cathodes formed into stripes in crosswise directions on the inner surfaces of the front substrate and the rear substrate respectively, a plurality of micro-tips for electron emission formed in arrays on the rear substrate on which the cathodes have been formed, and an insulation layer formed surrounding the micro-tips, the display having a resistance portion with a predetermined resistance value formed at a predetermined portion of the cathode. It is desirable to have the resistivity of the resistance portion be $10^5$ Ω.cm; the resistance portion be formed on a predetermined etched portion at the edge of the cathode; the cathode be formed to be a transparent conductor film; and the insulator layer be formed of $SiO_2$ or $Al_2O_3$.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE PREFERRED EMBODIMENTS

Referring to the attached drawings, a field emission display and a method therefor according to the present invention will be described below.

Figure 1:
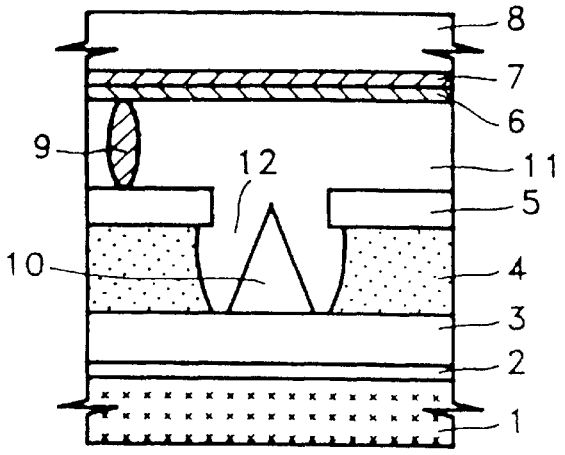
FIG. 1 (PRIOR ART)
FIG. 1 is a vertical cross-sectional view of a conventional field emission display.
Figure 2A:
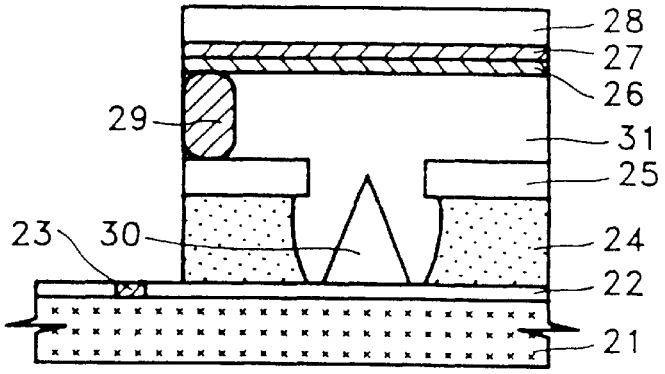
FIG. 2A is a vertical cross-sectional view of a field emission display according to the present invention.

FIG. 2A is a vertical cross-sectional view of a field emission display according to the present invention and FIG.

2B is a plan view of the field emission display according to the present invention.

Figure 2B:
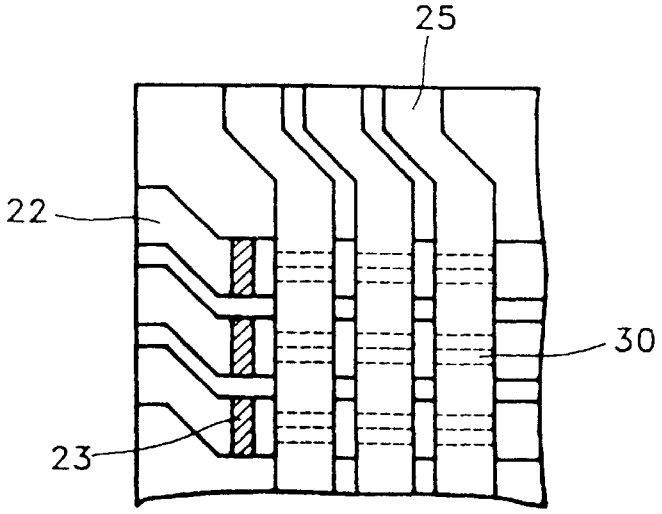
FIG. 2B is a plan view of the field emission display according to the present invention.

Referring to FIGS. 2A and 2B, a front glass substrate 28 and a rear glass substrate 21 are placed opposite to each other at a regular interval. An anode 27 and a cathode 22 are formed into stripes in directions crosswise with respect to each other, respectively on the inner surfaces of front glass substrate 28 and rear glass substrate 21. A resistance portion 23 is formed by etching a portion at the edge of cathode 22 and by evaporation deposition or by printing a resistance material. A micro-tip 30 is formed in an array on rear glass substrate 21 on which cathode 22 is formed into stripes. An insulator layer 24 is formed to surround micro-tip 30. A gate electrode 25 is formed on insulator layer 24 to have an aperture (a hole) for permitting field emission above micro-tip 30. A fluorescent material layer 26 is formed on front glass substrate 28 on which anode 27 is formed, for image display. A spacer 29 is formed to maintain the space of vacuum 31 between fluorescent material layer 26 and insulator layer 24.

The method for manufacturing a field emission device having the above structure is described as follows.

Figure 3A:
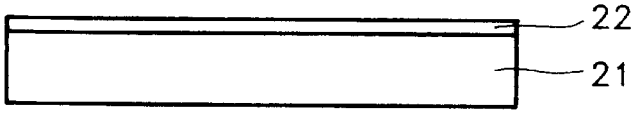
FIGS. 3A–3E are vertical cross-sectional views for explaining processing steps of a method for forming a resistance portion by employing a thin film formation technique.
Figure 3B:
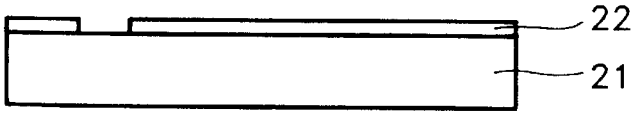
Figure 3C:
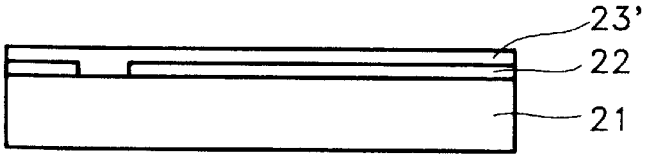

As illustrated in FIG. 3A, cathode 22 is formed by depositing ITO (indium tin oxide) as a layer in a thickness of 3000 Å on the rear glass substrate 21 and etching the layer into stripes. A portion at the edge of the pattern in cathode 22 is etched, as shown in FIG. 3B, and a resistance material layer 23' is deposited in the etched area by evaporation, as shown in FIG. 3C.

Figure 3D:
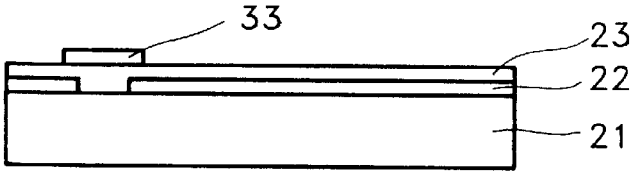
Figure 3E:
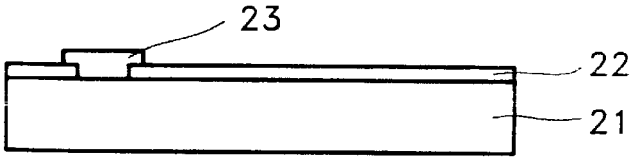
Figure 4A:
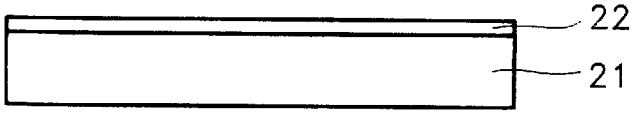
FIGS. 4A–4D are vertical cross-sectional views for explaining processing steps of a method for forming a resistance portion by employing a thick film formation technique.
Figure 4B:
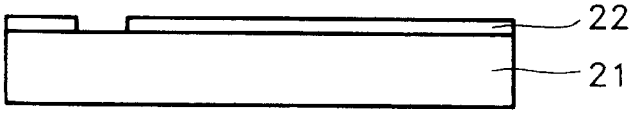
Figure 4C:
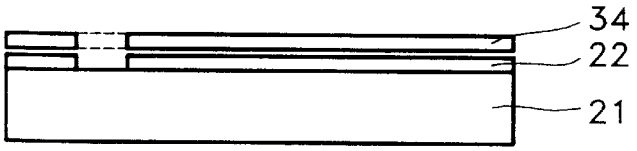
Figure 4D:
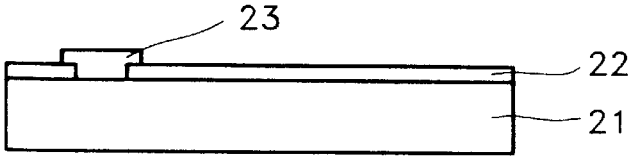

Then, as shown in FIG. 3D, resistance material layer 23' is covered with photoresist 33 and as shown in FIG. 3E, resistance portion 23 is completed by etching resistance material layer 23'. There are two techniques which can be employed here to form a resistance portion 23. One is a thin film formation technique, as shown in FIGS. 3A–3E, in which an area for resistance portion 23 is etched when cathode 22 is formed, and amorphous silicon as a resistance material is deposited and patterned in the area by evaporation. The other is a thick film formation technique, as shown in FIGS. 4A–4D, in which a ruthenium-based resistance portion is formed via a screen printing technique after being etched. Here, as shown in FIG. 4D, resistance portion 23 is formed in a portion of the edge of cathode 22 by utilizing a printing screen shown in FIG. 4C.

Then, insulator layer 24 is formed with $SiO_2$ or $Al_2O_3$ in a thickness of 1 $\mu$m on rear glass substrate 21 on which resistance portion 23 and cathode 22 are formed. A gate electrode layer 25 is formed with Mo or Cr deposited as a layer in a thickness of 3000 Å on insulator layer 24. A gate electrode 25 is formed by etching gate electrode layer 25 into stripes in a direction crosswise to the stripes of the cathode 22.

A hole having a diameter of about 1±0.2 $\mu$m is formed by etching from gate electrode 25 to the bottom of insulator layer 24, that is, to the surface of cathode 22, to make space for micro-tip 30 and field emission. Here, the formation of the hole is performed through two-step etching by utilizing a reactive ion etching (RIE) technique as an etching technique, for making an undercut below gate electrode 25.

Then, micro-tip 30 is formed in the inside of the hole for field emission, a spacer 29 is formed, and spacer 29 is covered with front glass substrate 28 on which anode 27 and fluorescent material layer 26 are formed. Thus, the manufacture of the field emission display is completed.

In a field emission display thus-manufactured, if a voltage of about 80–100 V is applied between cathode 22 having a negative potential and gate electrode 25 having a positive potential, electrons are emitted from micro-tip 30 due to a field effect. Here, the uniformity of the electrons emitted from micro-tip 30 can be improved by determining the resistivity value of resistance portion 23 at about $10^5$ Ω.cm and controlling the current between cathode 22 and gate electrode 25 to remain constant. The electrons emitted from micro-tip 30 pass through vacuum space 31, strike fluorescent material layer 26, and emit light, thereby enabling a desired image display. The distance between the surface of gate electrode 25 and the surface of fluorescent material layer 26 is about 200 $\mu$m and the distance is kept constant by spacer 29. The degree of vacuum in the field emission display is made to be about $10^{-6}$ to $10^{-7}$ torr.

As described above, the field emission display and method therefor according to the present invention, includes etching the edges of cathodes shaped into stripes and forming resistance portions in the etched areas, thereby improving excessive etching and roughness made in etching a hole in an area for forming a micro tip. Thus, the display is free of tip-adhesion reduction, so that process efficiency can be increased up to 90%, and the uniformity difference between the electrons emitted from a plurality of micro-tips can be maintained at about ±5% in the edge and center of a cathode.

What is claimed is:

1. A field emission display, comprising:

a front substrate and a rear substrate, each having inner surfaces disposed opposite to each other at a predetermined distance;

an anode and a cathode disposed on the inner surfaces of said front substrate and said rear substrate, respectively;

a micro-tip disposed on said cathode;

an insulation layer having a hole therein surrounding said micro-tip; and a resistance portion having a predetermined resistivity disposed on a predetermined portion of said cathode in a longitudinal direction along only one edge of the micro-tip.

2. A field emission display according to claim 1, wherein the predetermined resistivity of said resistance portion is $10^5$ Ω.cm.

3. A field emission display according to claim 1, wherein said resistance portion is formed in a predetermined etched portion at an edge of said cathode.

4. A field emission display according to claim 1, wherein said cathode is comprised of transparent conductor films and said insulator layer is comprised of $SiO_2$ or $Al_2O_3$.

5. A field emission display according to claim 1, wherein said resistance portion is formed by a thin film formation process.

6. A field emission display according to claim 1, wherein said resistance portion is formed by a thick film formation process.

7. A field emission display, comprising:

a rear substrate;

a cathode disposed on said rear substrate;

a cone-shaped micro-tip disposed on said cathode;

an insulating layer having a hole therein surrounding said micro-tip;

a gate, having an aperture defined around said micro-tip at a predetermined space from said micro-tip, disposed on said insulating layer;

a resistance portion formed in a predetermined etched portion of said cathode in a longitudinal direction along only one edge of the micro-tip; and a front substrate arranged with a first surface opposed to said rear substrate at a predetermined distance, and having an anode disposed on the first surface.

8. A method for manufacturing a field emission display device, comprising the steps of:

(a) forming a cathode layer having a striped pattern on a first glass substrate;

(b) etching a predetermined portion of the cathode layer;

(c) forming a resistance portion into the etched portion of the cathode layer;

(d) forming an insulator layer on said first glass substrate;

(e) depositing a gate electrode layer on said insulation layer and etching said gate electrode layer to form a gate electrode having a stripe pattern perpendicular to the striped pattern of said cathode layer;

(f) forming a photoresist layer on said insulation layer;

(g) etching said photoresist layer to form a hole therein;

(h) etching said gate electrode layer using said photoresist as a mask;

(i) etching said insulation layer to form a hole therein;

(j) forming a field emitting micro-tip on said cathode layer such that said insulator layer surrounds said micro-tip;

(k) removing said photoresist layer;

(l) forming a spacer on said gate electrode layer;

(m) forming an anode layer on a first surface of a second glass substrate; and (n) forming a fluorescent material layer on said anode layer, said spacer being positioned between said fluorescent material layer and said gate electrode layer and said second glass substrate being arranged with the first surface opposed to said first glass substrate at a predetermined distance.

9. A method for manufacturing the field emission display as claimed in claim 8, wherein the cathode layer is formed of indium tin oxide (ITO) at thickness of about 3,000 Å.

10. A method for manufacturing the field emission display as claimed in claim 8, wherein the insulation layer is formed of one of silicon dioxide ($SiO_2$) and aluminium oxide ($Al_2O_3$) approximately 1.0 $\mu$m thick.

11. A method for manufacturing the field emission display as claimed in claim 8, wherein the gate electrode layer is formed of one of molybdenum (Mo) and chromium (Cr) approximately 3,000 Å thick.

12. A field emission display device formed according to the method of claim 8.

13. A method for manufacturing the field emission display as claimed in claim 8, wherein said step (c) includes a thin film formation method in which amorphous silicon is deposited into the etched portion of the cathode layer and patterned by evaporation.

14. A method for manufacturing the field emission display as claimed in claim 8, wherein said step (c) includes a thick film formation method in which a ruthenium-based portion is formed into the etched portion of the cathode layer by a screen printing technique.

15. A field emission display according to claim 1, wherein the resistance portion is comprised of amorphous silicon.

16. A field emission display according to claim 1, wherein the resistance portion is comprised of ruthenium.

* * * * *